US006212978B1

(12) United States Patent
Seber et al.

(10) Patent No.: US 6,212,978 B1
(45) Date of Patent: Apr. 10, 2001

(54) SELF-ADJUSTING PLIERS

(76) Inventors: Brett P. Seber, 650 Sheridan Ave., Escondido, CA (US) 92026; Eric B. Carmichael, 210 S. Helix Ave. Apt. L, Solana Beach, CA (US) 92075

( * ) Notice: Subject to any disclaimer, the term of this patent is extended or adjusted under 35 U.S.C. 154(b) by 0 days.

(21) Appl. No.: 09/334,055

(22) Filed: Jun. 15, 1999

(51) Int. Cl.[7] ..... B25B 7/04
(52) U.S. Cl. ..... 81/357; 81/358
(58) Field of Search ..... 81/357, 355, 358, 81/359, 360, 361, 364, 342, 367, 368, 370, 372

(56) References Cited

U.S. PATENT DOCUMENTS

| | | | | |
|---|---|---|---|---|
| 4,541,312 | | 9/1985 | Petersen . | |
| 4,651,598 | | 3/1987 | Warheit . | |
| 4,662,252 | | 5/1987 | Warheit . | |
| 4,730,524 | * | 3/1988 | Petersen | 81/367 |
| 4,802,390 | * | 2/1989 | Warheit | 81/341 |
| 4,922,770 | * | 5/1990 | Dlugolecki et al. | 81/357 |
| 5,020,399 | * | 6/1991 | Annis et al. | 81/358 |
| 5,408,904 | * | 4/1995 | Neff | 81/360 |

* cited by examiner

*Primary Examiner*—James G. Smith
*Assistant Examiner*—Hadi Shakeri

(57) ABSTRACT

A self-adjusting pliers has an upper arm with an upper jaw at a first end and an upper handle at a second end. A support extends downwardly from an intermediate location of the upper arm. The support has a first downwardly extending slot and a second downwardly extending slot that is parallel to the first downwardly extending slot and closer to the upper handle than the first downwardly extending slot. The second downwardly extending slot has a plurality of second-slot teeth on a side thereof adjacent to the first downwardly extending slot. A lower arm includes a first end, and a lower handle at a second end. A control arm is pivotably connected at a first end to the upper handle and at a second end to the lower arm at an intermediate location between the first end and the lower handle. A spring is affixed at a first end to the upper arm at a location adjacent to the first end thereof, and affixed at a second end to the control arm so as to resist rotation of the control arm. A lower jaw member includes a lower jaw at a first end and in a facing relationship to the upper jaw. A slider extends from a side of the lower jaw member and is slidably engaged to the first downwardly extending slot. A pawl is disposed within the second downwardly extending slot and has a set of pawl teeth in facing relationship to the second slot teeth. A shifter has three pivot points arranged in a triangular pattern, the three pivot points being respectively connected to the lower jaw member, to the pawl, and to the first end of the lower arm.

16 Claims, 4 Drawing Sheets

SELF-ADJUSTING PLIERS

BACKGROUND OF THE INVENTION

This invention relates to pliers, and, more particularly, to a self-adjusting pliers that grips workpieces of various sizes without manual adjustment.

The traditional version of a pliers includes two elongated members joined at a pivot pin. One end of each elongated member forms a jaw, and the other forms a handle. Workpieces of different sizes are grasped in different manners, due to the constant geometry of the elongated members and the jaws. Some adjustability may be achieved by providing a slotted receiver in one of the handles, so that the handle with the pivot pin may be moved between different positions in the slot to provide adjustability for gripping objects of different sizes.

U.S. Pat. No. 4,651,598 provides an improved pliers whose jaws are self adjusting according to the size of the workpiece. Commercial versions of this pliers are useful, but have important drawbacks. Perhaps the most significant problem with the pliers made according to the '598 patent is that the jaws move relative to each other in an end-to-end manner as they are clamped down onto a workpiece. Soft workpieces such as brass or copper may be marred as a result. The clamping force applied by these pliers depends upon the size of the workpiece being grasped. Additionally, these pliers cannot be locked closed for convenient carrying and storage.

Another problem with the pliers of the '598 patent is that they do not lock to the workpiece, an important convenience in some uses of pliers. Overcenter locking pliers are described in a series of patents such as U.S. Pat. No. 4,541,312. Conventional overcenter locking pliers provide adjustability in the size of the workpiece that may be gripped through a screw adjustment to the pivoting position of the control arm, but this adjustability is not automatic in the sense of the pliers of the '598 patent.

Other types of locking pliers such as the AutoLock™ pliers combine the self-adjusting feature with an overcenter locking mechanism. This pliers can be inconvenient to use for some sizes of workpieces, suffers from some of the problems of the pliers of the '598 patent, does not achieve a large gripping force, and may unexpectedly unlock when large objects are being gripped.

There is a need for a self-adjusting pliers which does not experience shifting of the jaw position as the object is grasped, and which may be provided in a locking version. The present invention fulfills this need.

SUMMARY OF THE INVENTION

The present invention provides a self-adjusting pliers wherein the jaws automatically adjust to various sizes of workpieces. There is no end-to-end relative movement of the jaws as they grasp the workpiece, so that there can be no marring of the type observed with the pliers of the '598 patent. The clamping force is substantially constant regardless of the size of the workpiece, but is adjustable in some versions of the pliers. The pliers may be provided with no locking or releasable overcenter locking, or the ability to switch between the two.

In accordance with the invention, a self-adjusting pliers comprises an upper arm including an upper jaw at a first end thereof, an upper handle at a second end thereof, a support extending downwardly from an intermediate location thereof, a first downwardly extending slot in the support, and a second downwardly extending slot in the support. The second downwardly extending slot is parallel to the first downwardly extending slot and closer to the upper handle than the first downwardly extending slot. The second downwardly extending slot has a plurality of second-slot teeth on a side thereof adjacent to the first downwardly extending slot. A lower arm includes a first end thereof, and a lower handle at a second end thereof. A control arm is pivotably connected at a first end to the upper arm and at a second end to the lower arm at an intermediate location between the first end and the lower handle. A spring is affixed at a first end to the upper arm at a location adjacent to the first end thereof, and affixed at a second end to the control arm so as to resist rotation of the control arm. A lower jaw member includes a lower jaw at a first end thereof, the lower jaw being in a facing relationship to the upper jaw, and a slider extending from a side of the lower jaw member. The slider is slidably engaged to the first downwardly extending slot. A pawl is disposed within the second downwardly extending slot and has a set of pawl teeth in facing relationship to the second-slot teeth. A shifter has three pivot points arranged in a triangular pattern, the three pivot points being respectively connected to the lower jaw member, to the pawl, and to the first end of the lower arm.

The lower jaw member is not part of or rigidly fixed to the lower arm. Instead, it slides in the first slot, so that it necessarily produces a controlled, perpendicular clamping force on the workpiece being grasped. The lower jaw member cannot move in a sideways or end-to-end fashion, thereby overcoming a significant fault in some prior self-adjusting pliers. The locking and clamping force is applied by the user's hand force through the two handles and thence through the pawl mechanism acting against the teeth in the second slot and through the rigid-body pivoting shifter. The two functions of the guiding of the movement of the lower jaw member and the application of force are thus separated to ensure that the movement of the lower jaw member is true.

The two slots may be straight or curved. When the two slots are straight, the force applied to the workpiece being grasped is approximately constant, but varies slightly for different sizes of workpieces. When the slots are curved, it is preferred that they have a curvature substantially parallel to a locus of movement of the second end of the control arm as it pivots about its first end. In this case, the force applied to a workpiece is substantially constant for all sizes of workpieces, an important advantage for some applications.

The pliers may be provided with control over the force applied to the workpiece through the jaws. A manual force adjuster acting on the control arm is provided at a location adjacent to the first end of the control arm. The manual force adjuster is operable to move the control arm in a direction along the length of the upper arm. This movement of the first end of the control arm changes its angle and position relative to the lower arm and to the jaw member, with the result that the clamping force applied through the jaws is controllably variable.

The pliers may also be provided with a releasable overcenter lock for the jaws. In this version, there is a downwardly extending lobe on the control arm. A release arm is pivotably connected to the lower arm and has a release pad disposed to contact the lobe of the control arm when the release arm is pivoted. In operation, the control arm moves to an overcenter position when the clamping force is fully applied. This overcenter position may be released to unlock the jaws from the workpiece either by pulling the handles apart, or by manually pivoting the release arm. The overcenter locking is readily released by pulling the handles apart when the clamping force is small, but is more conveniently released by operating the release arm when the clamping force is large.

In another version, the pliers is controllably switchable between a non-locking function and a locking function. A locking function switch is movable between a first position whereat it does not block pivoting movement of the release arm, and a second position whereat it does block pivoting movement of the release arm. The blocking of the movement of the release arm when the locking function switch is in the second position prevents the functioning of the release arm and the movement of the control arm to the overcenter position, and thereby prevents the locking function.

It is preferred to combine the features of the manual force adjuster and the releasable overcenter lock in a single pliers, when either feature is provided.

The clamping mechanism of the invention is operable to move the lower jaw member upwardly along the first downwardly extending slot until the lower jaw contacts the workpiece, thereafter to lock the lower jaw member to the second downwardly extending slot, and to transfer a clamping force to the lower jaw. The clamping mechanism is thus self-adjusting to accommodate any size workpiece that will fit between the jaws. The lower jaw member and the lower jaw are constrained to move along the first slot, independent of the functioning of the locking feature that operates in conjunction with the second slot, ensuring a true movement. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
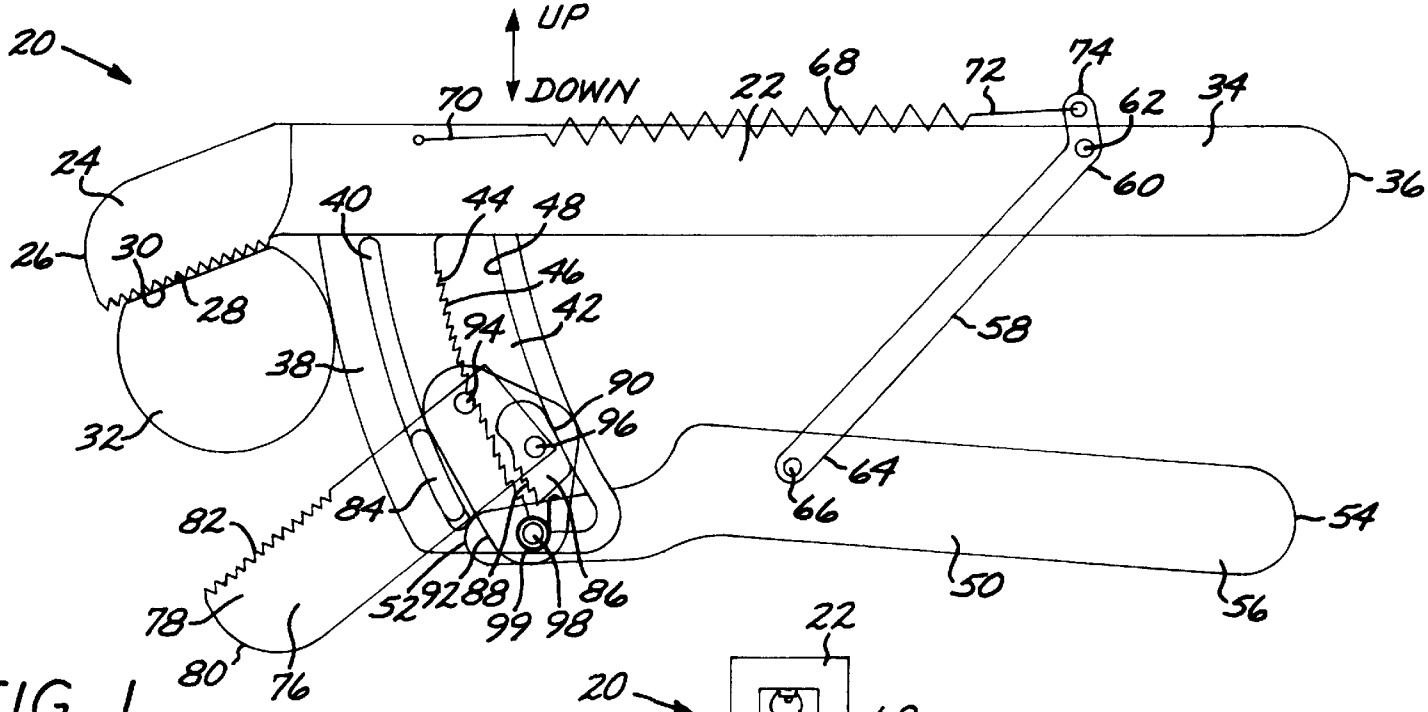
FIG. 1 is a schematic elevational view of a pliers, with the jaws in the fully open position.
Figure 2:
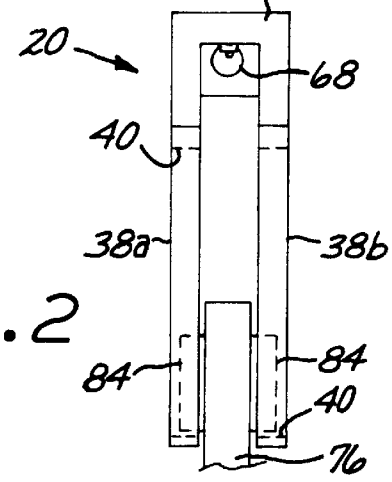
FIG. 2 is a schematic end view of the pliers, from the jaw end.

FIG. 1 illustrates a pliers 20 according to one embodiment of the invention. The figures are all schematic drawings illustrating external features and internal mechanisms in a single plane, for clarity in describing the interrelationships of the elements. "Up" and "down" reference directions are indicated on FIG. 1. The pliers 20 comprises an upper arm 22 with an upper jaw 24 at a first end 26 of the upper arm 22. The upper arm 22 has a cross-sectional shape preferably in the form of an inverted "U", with the opening of the "U" pointing downwardly, as seen in FIG. 2. (In FIG. 2, some elements are omitted for clarity.) The upper jaw 24 preferably has a pattern of gripping ridges 28 on its lower side 30 for engaging a workpiece 32. An upper handle 34 is at an oppositely disposed second end 36 of the upper arm 22. The upper handle 34 is configured for comfortable gripping by a user operating the pliers 20, and may be contoured and/or provided with a resilient plastic covering.

A support 38 is affixed to and extends downwardly from the upper arm 22 at an intermediate location between the first end 26 and the second end 36. The support 38 desirably includes two parallel and spaced-apart support bodies 38*a* and 38*b*, as seen in FIG. 2.

Two slots are provided in the support 38, extending through the support bodies 38*a* and 38*b*. A first slot 40 extends downwardly and has smooth side walls. A second slot 42 extends downwardly parallel to the first slot 40, at a location rearward of the first slot and thence closer to the upper handle 34 than the first slot 40. The two slots 40 and 42 are illustrated in FIG. 1 as curved, and the curvature will be discussed subsequently. They are locally parallel to each other, even though curved. The slots 40 and 42 may instead be straight. A first side 44 of the second slot 42, closest to the first slot 40, has second-slot teeth 46 thereon. An oppositely disposed second side 48 of the second slot 42, closest to the upper handle 34, is smooth.

A lower arm 50 has a first end 52 and an oppositely disposed second end 54. The lower arm 50 preferably has a cross section in the form of an upwardly opening "U" shape. A lower handle 56 is present toward the second end 54. As with the upper handle 34, the lower handle 56 is configured for comfortable gripping by a user operating the pliers 20, and may be contoured and/or provided with a resilient plastic covering. Force is applied to the workpiece 32 by the hand of the user of the pliers 20 acting through the two handles 34 and 56.

A control arm 58 is pivotably connected at a first end 60 thereof to an upper control arm pivot pin 62 on the upper arm 22 at a location within or adjacent to the upper handle 34. A second end 64 of the control arm 58 is pivotably connected to a lower control arm pivot pin 66 at an intermediate location between the ends 52 and 54 of the lower arm 50.

A spring 68 is affixed at a first end 70 thereof to the upper arm 22 at a location adjacent to the first end 26 of the upper arm 22. A second end 72 of the spring 68 is affixed to a spring extension 74 of the control arm 58. The spring extension 74 extends beyond the portion of the control arm 58 that is affixed to the upper control arm pivot pin 62, preferably at an angle to the control arm 58. The preferred angle between the spring extension 74 and the control arm 58 is about 45 degrees, although other angles are operable. The spring force of the spring 68 applied through the spring extension 74 serves to resist rotation of the control arm 58, in the clockwise direction in the view of FIG. 1.

The mechanism associated with the upper arm 22, including the first end 60 of the control arm 58, the upper control arm pivot pin 62, the spring 68, and the spring extension 74, are hidden from external view within the interior of the U-shaped upper arm 22. Similarly, the second end 64 of the control arm 58 and the lower control arm pivot pin 66 are hidden from external view within the interior of the U-shaped lower arm 50.

A lower jaw member 76 includes a lower jaw 78 at a first end 80 thereof. The lower jaw 78 preferably has a pattern of upwardly facing gripping ridges 82 thereon. The gripping ridges 28 and 82 are in facing relationship to each other, and serve to grasp the workpiece 32 firmly therebetween.

A slider 84 extends from each side of the lower jaw member 76, as seen in FIGS. 1 and 2. The slider 84 is shaped to be received within, and to slide within, the first slot 40. The slider 84 is straight where the first slot 40 is straight, and is curved to match the curvature of the first slot 40, when the first slot 40 is curved. The slider 84 is dimensioned so that its fit into the first slot 40 is sufficiently loose to prevent binding of the slider 84 to the sides of the first slot 40 during operation. The slider 84 constrains the movement of the lower jaw 78 so that it has a perpendicular or near-perpendicular incidence to the upper jaw 24 when the workpiece is grasped between the jaws. This constraint prevents any end-to-end or side-to-side relative movement of the jaws 78 and 24, which would tend to gouge the workpiece. This constraint is an important advantage of the present invention, achieved with the use of two slots 40 and 42, rather than a single slot.

A pawl 86 is captured within and disposed within the second slot 42 of each of the support bodies 38*a* and 38*b*. (That is, there are preferably two pawls 86, but one pawl would be sufficient for the pliers to operate.) Each pawl 86 has a set of pawl teeth 88 thereon, in facing relationship to the second slot teeth 46. A second side 90 of the pawl 88, oppositely disposed from the pawl teeth 88, is smooth and in facing relationship to the smooth second side 48 of the second slot 42. The functioning of the pawl 86 will be subsequently discussed in relationship to FIGS. 3–6.

A shifter 92 is a plate that transfers force applied to the handles into the lower jaw 78. There may be two plate shifters 92, one outside of each of the support bodies 38*a* and 38*b*. Equivalently, there may be a single shifter 92 disposed between the two support bodies 38*a* and 38*b*. Each shifter 92 has three pivot points thereon arranged in a triangular pattern. The three pivot points on the shifter 92 are respectively connected to a lower jaw member pivot pin 94 on the lower jaw member 76, a pawl pivot pin 96 on the pawl 86, and a lower arm pivot pin 98 at the first end 52 of the lower arm 50. The shifter 92 provides the interconnection between the lower arm 50, the pawl 86, and the lower jaw member 76. That is, the lower jaw member 76 is not integral with the lower arm 50.

A torsion spring 99 is wound around the lower arm pivot pin 98 and anchored on the lower arm 50. The torsion spring 99 resists rotational movement of the lower arm 50 relative to the lower arm pivot pin 98.

Figure 4:
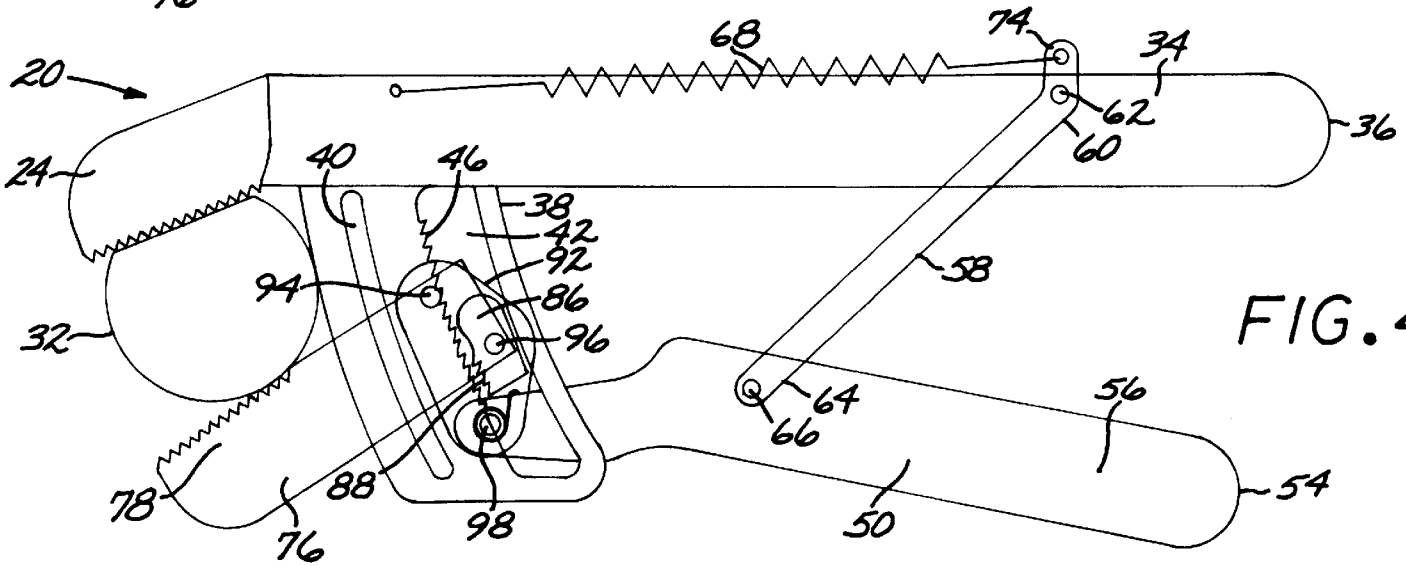
FIG. 4 is a schematic elevational view like that of FIG. 1, at the position where the lower jaw contacts the workpiece.
Figure 5:
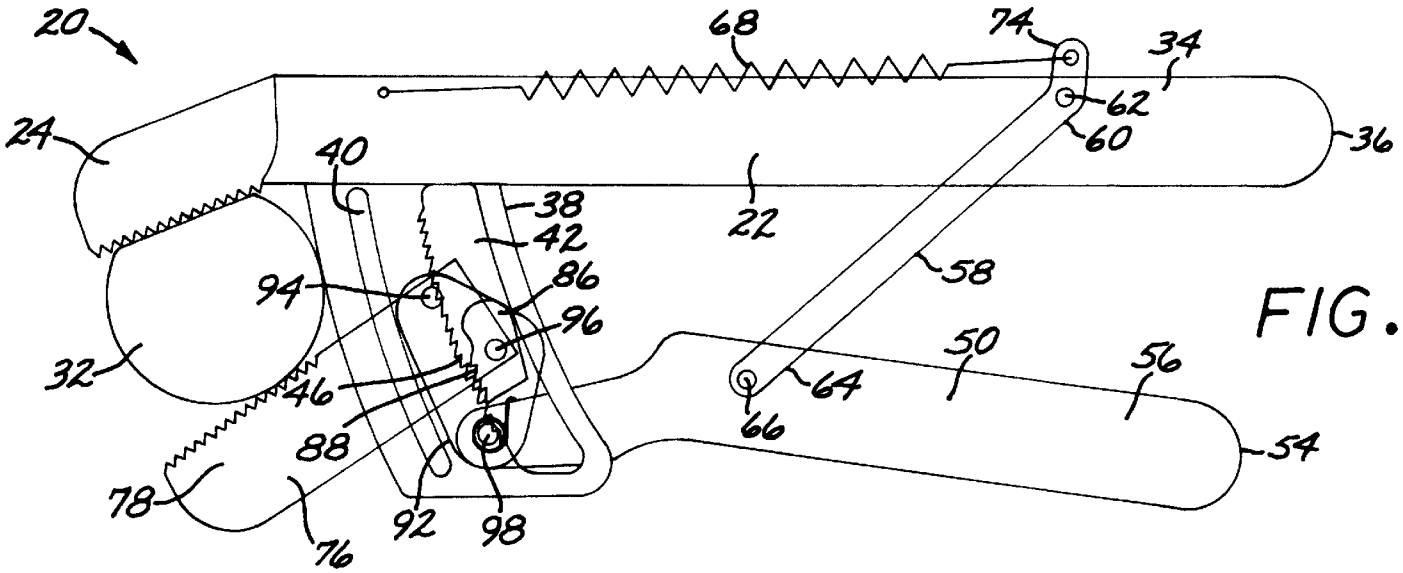
FIG. 5 is a schematic elevational view like that of FIG. 1, as force is applied to the workpiece.
Figure 6:
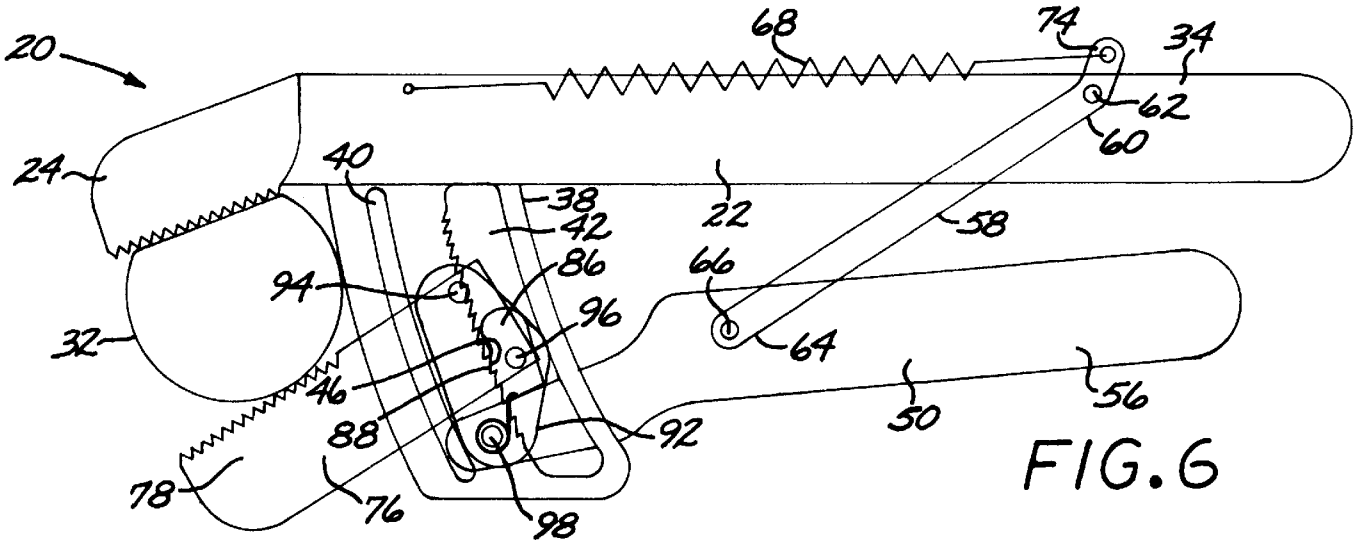
FIG. 6 is a schematic elevational view like that of FIG. 1, as the lower handle is pivoted toward an overcenter position.

FIGS. 1 and 3–6 provide a sequential depiction of the movement of the mechanism of the pliers 20 from an initial position in FIG. 1 to a near-final position in FIG. 6. Not all elements are shown and labeled in FIGS. 3–6, so that the operation of the mechanism is not obscured. In FIG. 1, the mechanism is in a relaxed, filly open position, with no force applied through the handles 34 and 56. The workpiece 32 is not yet grasped between the jaws 24 and 78, the slider 84 is free to slide within the first slot 40 to move the lower jaw member 76 upwardly, and the pawl 86 is free to slide within the second slot 42 with the second side 90 of the pawl 86 sliding along the second side 48 of the second slot 42.

Figure 3:
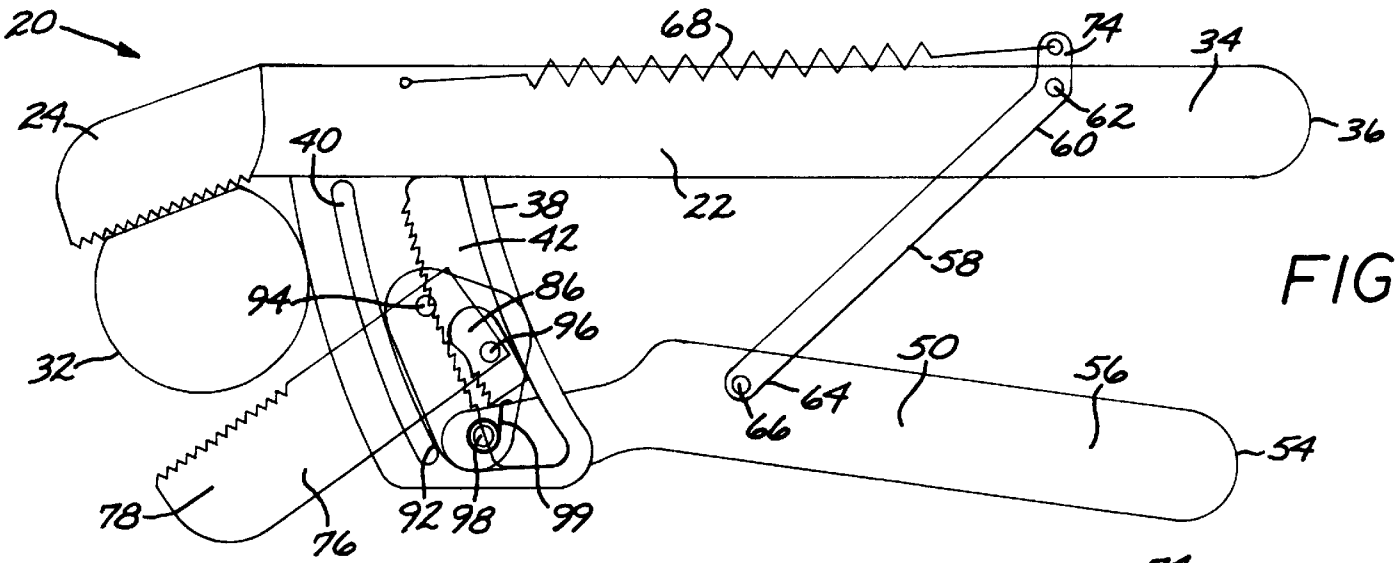
FIG. 3 is a schematic elevational view like that of FIG. 1, after initial activation of the pliers handles.

This configuration is retained, see FIG. 3, as a force is applied through the arms 22 and 50, the lower handle 56 is moved upwardly, thereby acting through the shifter 92 to move the lower jaw member 76 upwardly to approach contact to the workpiece 32. Simultaneously, the control arm 58 pivots about the upper control arm pivot pin 62, clockwise in the view of FIG. 3, so that the spring 68 extends. The spring extension creates a relatively small force that resists the upward movement of the lower handle 56, giving the user of the pliers 20 a feel for the positioning and movement of the lower handle 56. This spring extension force also serves as a restoring force that moves the arms 22 and 50 apart to the jaw-open or relaxed position of the pliers 20 shown in FIG. 1, if no force is applied to the handles 34 and 56.

With continued upward movement of the lower handle 56, the lower jaw 78 contacts the workpiece so that it can no longer move upwardly, as seen in FIG. 4. At this point, the continued movement of the lower handle 56 causes the shifter 92 to rotate in rigid-body motion in the clockwise direction in FIG. 4. The rigid-body rotation of the shifter 92 draws the pawl 86 forwardly, engaging the pawl teeth 88 to the second-slot teeth 46, as seen in FIG. 5. This engagement between the sets of teeth 88 and 46 effectively produces a new clamping pivot point, whose location along the second slot 42 varies according to the size of the workpiece 32. The smaller the workpiece 32, the further upwardly along the second slot 42 is the point where the sets of teeth 88 and 46 engage. With continued upwardly movement of the lower handle 56, as in FIG. 6, the shifter 92 rotates about this effective clamping pivot point, causing the lower jaw member 76 to rotate about the clamping pivot point and, in cooperation with the upper jaw 24, to apply clamping force to the workpiece 32.

In all of this movement depicted in FIGS. 1 and 3–6, the movement of the lower jaw member 76 is constrained by the slider 84 to travel along the first slot 40. Also during the movement of FIGS. 1 and 3–6, the second end 64 of the control arm 58 follows a locus of points as it pivots about the upper control arm pivot pin 62. Desirably, the first slot 40 and the second slot 42 are shaped with the same curvature as this locus of points or, alternatively stated, the first slot 40 and the second slot 42 are parallel to the locus of points defined by the second end 64. With this preferred configuration for the slots 40 and 42, the clamping force applied to the workpiece 32 is the same, regardless of the size of the workpiece 32. The closer the curvature of the slots 40 and 42 to that of the locus of points of the second end 64, the closer is the clamping force to a constant value for all workpiece sizes that fit between the jaws 24 and 78. Even if the slots 40 and 42 are straight, the variation in the clamping force is relatively small, so that straight slots 40 and 42 may be used if it is not important to maintain the clamping force exactly constant.

Figure 7:
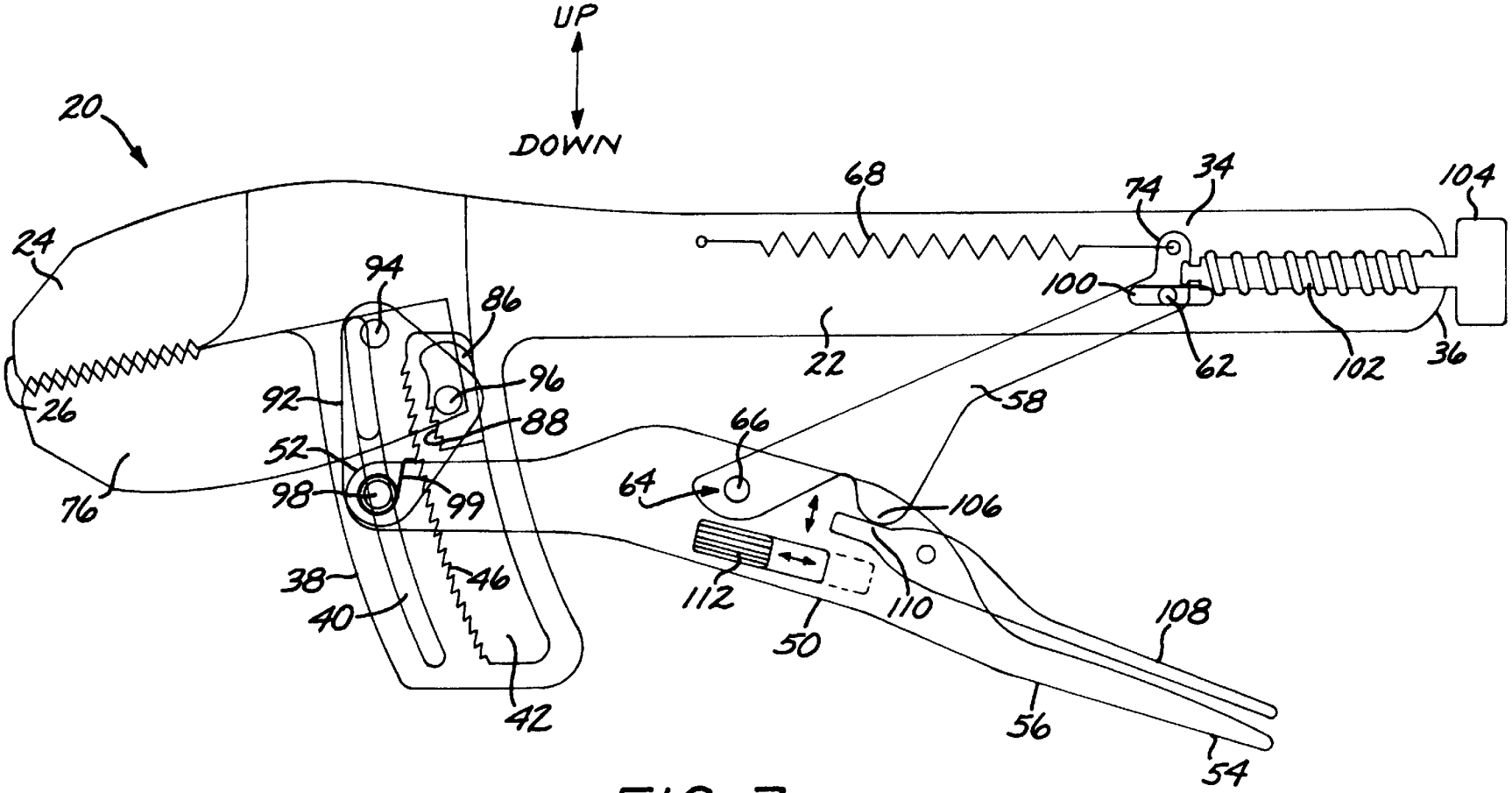
FIG. 7 is a schematic elevational view of a second embodiment of the pliers, with force adjustment and a locking release.

FIG. 7 depicts an embodiment of the pliers 20 that provides for both adjustability of the clamping force applied through the jaws 24 and 78, and also for overcenter locking and release of the clamping force. These two features of force adjustability and overcenter locking and release are desirably provided together, but they may be provided separately. The basic closing and opening mode of this pliers 20 of FIG. 7 is the same as that shown in FIGS. 1–6. Features common to the embodiment of FIGS. 1–6 are identified by the same numerals, and the prior discussion of FIGS. 1–6 is incorporated herein.

The clamping force adjustability is provided by moving the upper control arm pivot pin 62 in a track 100 in the upper arm 22, along the length of the upper arm 22 in the direction between the first end 26 and the second end 36. The maximum travel required to achieve a substantial variation in the clamping force is relatively small, and typically is about ¼ inch. The movement of the upper control arm pivot pin 62 along the track 100 is accomplished with a screw drive 102 and a manual screw movement knob 104 that extends from the second end 36 of the upper arm 22.

The overcenter locking and release is conveniently provided by placement of an unlocking lobe 106 on the lower side of the control arm 58. A release arm 108 is pivotably connected to the lower arm 50, at a location between the first end 52 and the second end 54 and accessible to the hand of the user of the pliers 20 at the second end 54. A release pad 110 on the upper side of the release arm 108 is disposed to contact the unlocking lobe 106. In operation, the lower control arm pivot pin 66 moves to an overcenter position relative to the upper control arm pivot pin 62 and the lower arm pivot pin 98, when the lower handle 56 is moved upwardly to the limit of its travel. Stated alternatively, when the lower handle 56 is fully open (moved to its downward limit of travel) as in FIG. 1, the lower control arm pivot pin 66 lies below a straight line drawn between the upper control arm pivot pin 62 and the lower arm pivot pin 98. As the lower handle 56 is moved upwardly, the lower control arm pivot pin 66 moves closer to a straight-line relationship between the pins 62 and 98, and eventually crosses over that straight line to lie above the straight line drawn between the pins 62 and 98. This is the overcenter lock position. To release the pliers 20 from this overcenter lock position, the release arm 108 is operated to rotate the release pad 110 upwardly against the unlocking lobe 106, and thereby force the lower arm 50 downwardly and out of the overcenter relationship.

The embodiment of FIG. 7 allows the pliers 20 to be selectively shifted between the non-locking version and the locking/release version. A lock switch 112 is provided to selectively prevent the pivoting movement of the release arm 108. That is, when the movement of the pliers 20 passes into the overcenter relationship, the release arm 108 is forced to pivot in the direction (counter-clockwise in the embodiment of FIG. 7) opposite to the pivoting movement of the release arm 108 during unlocking (clockwise in FIG. 7). The locking function may be prevented by preventing this movement of the release arm 108 as the movement reaches the overcenter position as the jaws are closed, so that the stationary release arm 108 prevents the movement of the control arm 58 from passing to the overcenter position. The lock switch 112 prevents the movement of the release arm 108 and the control arm 58 by physically contacting and interfering with the movement of the release arm 108. Thus, in the embodiment of FIG. 7, the lock switch 112 slides into an interfering position relative to the release arm 108 when slid to the right, so that the overcenter locking is not permitted. The pliers then serves as an ordinary non-locking pliers. When the lock switch 112 is slid to the left in the view of FIG. 7, it does not interfere with the rotation of the release arm 108, and the release arm 108 does not prevent the movement of the lobe 106 and thence the control arm 58 as it passes to the overcenter position. The pliers is a locking pliers in this configuration.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A self-adjusting pliers, comprising:

an upper arm including an upper jaw at a first end thereof, an upper handle at a second end thereof, a support extending downwardly from an intermediate location thereof, a first downwardly extending slot in the support, and a second downwardly extending slot in the support, the second downwardly extending slot being parallel to the first downwardly extending slot and closer to the upper handle than the first downwardly extending slot, the second downwardly extending slot having a plurality of second-slot teeth on a side thereof adjacent to the first downwardly extending slot;

a lower arm including a first end thereof, and a lower handle at a second end thereof;

a control arm pivotably connected at a first end to the upper arm and at a second end to the lower arm at an intermediate location between said first end of said lower arm and said lower handle;

a spring affixed at a first end to the upper arm at a location adjacent to said first end of said upper arm, and affixed at a second end to the control arm so as to resist rotation of the control arm;

a lower jaw member including a lower jaw at a first end thereof, the lower jaw being in a facing relationship to the upper jaw, and a slider extending from a side of the lower jaw member, the slider being slidably engaged to the first downwardly extending slot;

a pawl disposed within the second downwardly extending slot, the pawl having a set of pawl teeth in facing relationship to the second slot teeth; and a shifter having three pivot points arranged in a triangular pattern, the three pivot points being respectively connected to the lower jaw member, to the pawl, and to the first end of the lower arm.

2. The pliers of claim 1, wherein the first slot and the second slot are straight.

3. The pliers of claim 1, wherein the first slot and the second slot are curved.

4. The pliers of claim 1, wherein the first slot and the second slot are curved with a curvature substantially parallel to a locus of movement of the second end of the control arm as it pivots about its first end.

5. The pliers of claim 1, further including a manual adjuster means acting on the control arm at a location adjacent to said first end of said control arm, and operable to move the control arm in a direction along the length of the upper arm between the first end and the second end of the upper arm.

6. The pliers of claim 1, further including a downwardly extending lobe on the control arm, and a release arm pivotably connected to the lower arm and having a release pad disposed to contact the lobe of the control arm when the release arm is pivoted.

7. The pliers of claim 6, further including a lock switch slidable movable between a first position whereat it does not block pivoting movement of the release arm, and a second position whereat it does block pivoting movement of the release arm.

8. The pliers of claim 1, further including a manual adjuster means acting on the control arm at a location adjacent to said first end of said control arm, and operable to move the control arm in a direction along the length of the upper arm between the first end and the second end of the upper arm, a downwardly extending lobe on the control arm, and a release arm pivotably connected to the lower arm and having a release pad disposed to contact the lobe of the control arm when the release arm is pivoted.

9. The pliers of claim 8, further including a locking function switch slidably movable between a first position whereat it does not block pivoting movement of the release arm, and a second position whereat it does block pivoting movement of the release arm.

10. The pliers of claim 9, wherein the locking function switch is slidably movable.

11. A self-adjusting pliers operable to grasp a workpiece between an upper jaw and a lower jaw, comprising:

an upper arm including the upper jaw;

a lower arm;

a support extending downwardly from the upper arm toward the lower arm;

a first downwardly extending slot in the support;

a second downwardly extending slot in the support;

a control arm pivotably connected at a fist end to the upper arm and at a second end to the lower arm at an intermediate location of said lower arm;

a spring biasing the control arm so as to resist rotation of the control arm;

a lower jaw constrained to slide along the first downwardly extending slot, the lower jaw not being integral with the lower arm; and a clamping mechanism operable to move the lower jaw along the first downwardly extending slot until it contacts the workpiece, thereafter to lock the lower jaw to the second downwardly extending slot, and to transfer a clamping force to the lower jaw.

12. The pliers of claim 11, wherein the first downwardly extending slot is parallel to the second downwardly extending slot.

13. The pliers of claim 11, wherein the first downwardly extending slot and the second downwardly extending slot are parallel.

14. The pliers of claim 11, further including a manual adjuster means acting on the control arm and operable to move a pivot point at the first end of the control arm in a direction along the length of the upper arm.

15. The pliers of claim 11, further including a downwardly extending lobe on the control arm, and a release arm pivotably connected to the lower arm and having a release pad disposed to contact the lobe of the control arm when the release arm is pivoted.

16. The pliers of claim 15, further including a lock switch slidable movable between a first position whereat it does not block pivoting movement of the release arm, and a second position whereat it does block pivoting movement of the release arm.

* * * * *